United States Patent [19]

Merrill et al.

[11] 3,956,725

[45] May 11, 1976

[54] THERMALLY ACTUATABLE ELECTRICAL SWITCH CONSTRUCTION

[75] Inventors: Phillip Edward Merrill, Kettering; Emil Robert Plasko, Washington Township, Montgomery County, both of Ohio

[73] Assignee: Micro Devices Corporation, Dayton, Ohio

[22] Filed: Feb. 10, 1975

[21] Appl. No.: 548,665

[52] U.S. Cl. ..... 337/407; 337/409

[51] Int. Cl.[2] ..... H01H 37/76

[58] Field of Search ..... 337/402, 403, 404, 405, 337/407, 409

[56] References Cited

UNITED STATES PATENTS

| | | | |
|---|---|---|---|
| 2,934,628 | 4/1960 | Massar et al. | 337/409 |
| 3,291,945 | 12/1966 | Merrill et al. | 337/407 X |

*Primary Examiner*—J. D. Miller
*Assistant Examiner*—Fred E. Bell
*Attorney, Agent, or Firm*—Biebel, French & Nauman

[57] ABSTRACT

A thermally actuatable switch construction having a relatively thin and long and wide housing provided with a similarly shaped chamber therein and a pair of terminals extending into the chamber. A contact member is disposed in the chamber for respectively engaging and thereby electrically interconnecting the terminals together when the contact member is in one position in the chamber and for respectively moving away from contact with the terminals to thereby electrically disconnect the terminals from each other when the contact member is in another position in the chamber. A temperature sensitive member is disposed in the chamber and is adapted to collapse when the same is at a predetermined temperature. A biasing member is disposed in the chamber and is operatively associated with the temperature sensitive member and the contact member to hold the contact member in the one position thereof as long as the temperature sensitive member is in an uncollapsed condition thereof, the contact member extending substantially from side-to-side in the chamber.

4 Claims, 7 Drawing Figures

THERMALLY ACTUATABLE ELECTRICAL SWITCH CONSTRUCTION

This invention relates to an improved thermally actuatable switch construction.

It is well known that thermally actuatable switch constructions have been provided wherein a bridging member is held in conductive relation between two leads or terminals of the switch construction by a temperature sensitive member as long as the temperature sensitive member does not reach a predetermined temperature. When such temperature sensitive member reaches the predetermined temperature, the same collapses and through a certain spring arrangement, the bridging member is moved out of contact with at least one of the leads or terminals of the switch construction to open the electrical circuit thereof. For example, such prior known thermally actuated switch constructions are disclosed and claimed in the patents to Merrill, U.S. Pat. Nos. 3,180,958, 3,291,945 and 3,519,972.

It is a feature of this invention to provide a thermally actuatable switch construction of the above type wherein the bridging or contact member extends substantially from side-to-side in the chamber of the thermally actuatable switch construction.

In particular, one embodiment of this invention provides a thermally actuatable switch construction comprising a relatively thin and long and wide housing having a relatively thin and long and wide chamber therein and a pair of terminals extending into the chamber. A contact member is disposed in the chamber for respectively engaging and thereby electrically interconnecting the terminals together with the contact member in one position in the chamber and for respectively moving away from contact with the terminals to thereby electrically disconnect the terminals from each other when the contact member is in another position in the chamber. A temperature sensitive member is disposed in the chamber and is adapted to collapse when the same is at a predetermined temperature. A biasing member is disposed in the chamber and is operatively associated with the temperature sensitive member and the contact member to resiliently hold the contact member is in the one position thereof as long as the temperature sensitive member is in an uncollapsed condition thereof, the contact member extending substantially from side-to-side in the chamber.

Accordingly, it is an object of this invention to provide an improved thermally actuated switch construction having one or more of the novel features set forth above or hereinafter shown or described.

Other objects, uses, and advantages of this invention are apparent from a reading of this description which proceeds with reference to the accompanying drawings forming a part thereof and wherein.

Figure 1:
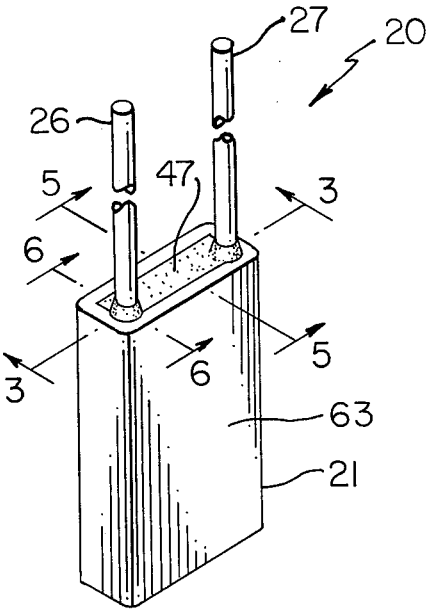
FIG. 1 is a perspective view illustrating the improved thermally actuatable switch construction of this invention.
Figure 2:
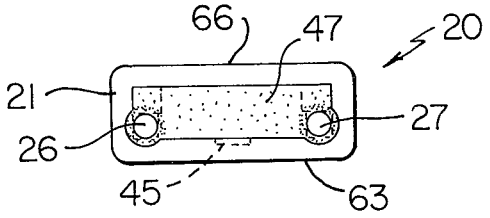
FIG. 2 is a top view of the switch construction of FIG. 1.

While the various features of this invention are hereinafter described and illustrated as being particularly adapted to provide a thermally actuatable switch construction of a particular configuration, it is to be understood that the various features of this invention can be utilized singly or in any combination thereof to provide a thermally actuatable switch construction having other configurations as desired.

Therefore, this invention is not to be limited to only the embodiment illustrated in the drawings, because the drawings are merely utilized to illustrate one of the wide variety of structural configurations.

Referring now to FIGS. 1–7, the improved thermally actuatable switch construction of this invention is generally indicated by the reference numeral 20 and comprises a cup-shaped housing member 21 that is substantially thin and long and wide and defines a similarly shaped chamber 25 therein whereby the housing 21 is substantially rectangular in any transverse cross section thereof.

A pair of terminals or lead means 26 and 27 respectively have bent ends 30 and 31 disposed inside the chamber 25 and outer portions 28 and 29 projecting out of the housing means 21 for coupling the thermally actuatable switch construction 20 in the desired electrical circuit as hereinafter described whereby the bent portions 30 and 31 of the terminals 26 and 27 define fixed contact means 33 and 34 inside the chamber 25.

Figure 5:
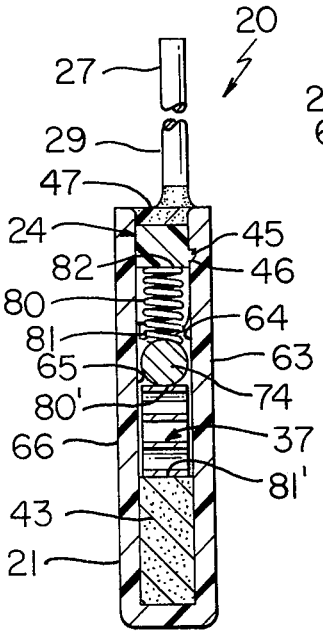
FIG. 5 is an enlarged, cross-sectional view taken on line 5—5 of FIG. 1.
Figure 7:
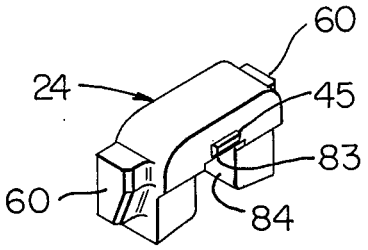
FIG. 7 is a perspective view of the end plug for the switch construction of FIG. 1.

An end plug 24, as best illustrated in FIG. 7, has a pair of opposed side projections 60 around which the bent ends 30 and 31 of the terminals 26 and 27 extend so that the same are held to the extensions 60 of the end plug 24 and can be inserted therewith down into the upper end of the chamber 25 until an outwardly directed tongue or tang 45 on the end plug 24 snaps into a cooperating recess 46 formed in the housing means in the manner fully illustrated in FIG. 5 to snap-fit the end plug 24 in the assembled position illustrated in the drawings to positively hold the terminals 26 and 27 in a fixed position relative to the housing means 21.

Figure 6:
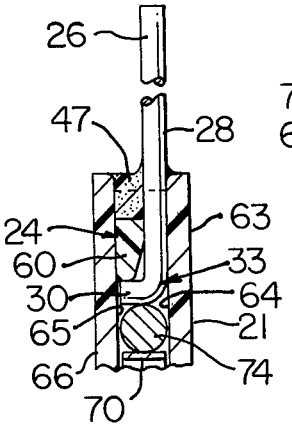
FIG. 6 is an enlarged, fragmentary, cross-sectional view taken on line 6—6 of FIG. 1.

It can be seen that the end plug 24 is so constructed and arranged that the terminals 26 and 27 are respectively disposed adjacent the opposed inside side walls 61 and 62 of the housing means 21 and are respectively disposed adjacent and against the front wall 63 of the housing means 21 while the bent portions 30 and 31 of the terminals 26 and 27 substantially extend from the inside surface 64 of the front wall 63 to closely adjacent the inside wall surface 65 of the rear wall 66 of the housing means 21 as best illustrated in FIG. 6.

The inside surfaces 61 and 62 of the opposed sidewalls 67 and 68 of the cup-shaped housing means 24 are so constructed and arranged that the same respectively have a pair of tapering or angled portions 69 and 70 extending toward each other as the same approach the bottom wall 71 of the cup-shaped housing 21. However, the tapering sides 69 and 70 subsequently join substantially parallel portions 72 and 73 of the inside surfaces 61 and 62 that extend to the bottom wall 71 as illustrated in FIG. 3.

In this manner, a substantially rectangularly shaped temperature sensitive member 43 is adapted to be press fitted down into the chamber 25 as the same has an original width slightly greater than the width between the parallel portions 72 and 73 of the side surfaces 61 and 62 so that when the temperature sensitive member 43 is pushed toward the bottom wall 71 of the housing 21, the tapering portions 69 and 70 of the surfaces 61 and 62 has caused the temperature sensitive member 43 to be completely wedged or press fitted into place and thereby be positively held in the bottom of the chamber 25 as illustrated. The temperature sensitive member 43 can be of the type described in the aforementioned patents to Merrill.

Figure 3:
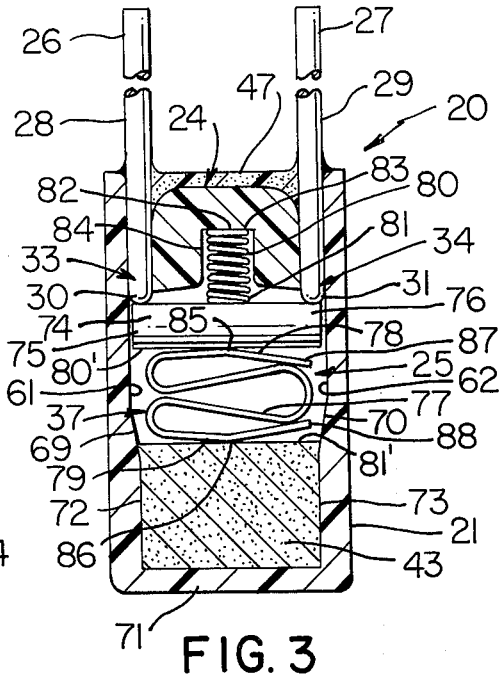
FIG. 3 is an enlarged, cross-sectional view taken substantially on line 3—3 of FIG. 1.

A contact means or member 74 is disposed in the chamber 25 and comprises a cylindrical conductive member having opposed ends 75 and 76 disposed closely adjacent the inside surfaces 61 and 62 of the housing means 21, the opposed ends 75 and 76 of the cylindrical contact member 74 respectively abutting against the bent portions 30 and 31 of the terminals 26 and 27 when the contact member 74 is held in the one position illustrated in FIG. 3 through the cooperation of a biasing means 37 and the temperature sensitive member 43 as long as the temperature sensitive member 43 is in the uncollapsed condition of FIG. 3.

Figure 4:
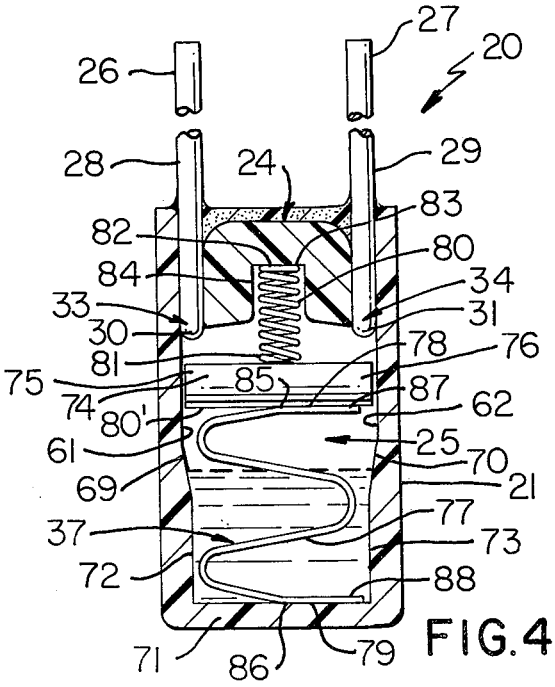
FIG. 4 is a view similar to FIG. 3 and illustrates the thermally actuatable switch construction after the same has been thermally actuated.

In particular, the biasing means 37 comprises a reversely looped leaf spring 77 having opposed ends 78 and 79 respectively disposed in contact with the external peripheral surface 80 of the contact member 74 and the upper surface 81 of the temperature sensitive member 43 as illustrated whereby the leaf spring member 77 is held under compression from its substantially natural condition as illustrated in FIG. 4 by the uncollapsed temperature sensitive member 43.

In this manner, the force of the compressed leaf spring 77 maintains the contact member 74 in good electrical contact with the bent ends 30 and 31 of the terminals 26 and 27 to complete the circuit therebetween as long as the temperature sensitive member 43 remains in the uncollapsed condition illustrated in FIG. 3.

However, when the temperature sensitive member 43 is sensing a predetermined temperature thereof, the same collapses in the manner illustrated in FIG. 4 to permit the compressed leaf spring 77 to fully expand and thereby loose its compressive force on the contact member 74 whereby another spring 80 disposed between the contact member 74 and the end plug 24 is adapted to force the contact member 74 away from the contact ends 33 and 34 of the terminals 26 and 27 in the manner illustrated in FIG. 4 to thereby disconnect the terminals 26 and 27 from each other for the reasons hereinafter described.

The spring 80 comprises a coiled compression spring having one end 81 thereof disposed against the contact member 74 intermediate its ends 75 and 76 while the other end 82 of the spring 80 is disposed against an end wall 83 of a central recess 84 formed in the end plug 24E as illustrated whereby the compression spring 80 can be compressed into the recess 84 when the contact member 74 is held against the bent ends 30 and 31 of the terminals 26 and 27 by the compressed leaf spring 77 when the temperature sensitive member 43 is in the uncollapsed condition illustrated in FIG. 3 since the force of the compressed leaf spring 77 is much greater than the force of the compressed compression spring 80. However, the force of the compression spring 80 is sufficient to rapidly move the contact member 74 away from the ends 30 and 31 of the terminals 26 and 27 when the leaf spring 77 looses its compressive force through the action of the heat sensitive member 43 collapsing in the manner illustrated in FIG. 4 by the same sensing a predetermined temperature.

In order to insure that the ends 78 and 79 of the spring 77 exert force substantially medially of the contact member 74 and the temperature sensitive member 43, the ends 78 and 79 of the leaf spring 77 are bent medially thereof at the points 85 and 86 so that the angles or apexes 85 and 86 of the bent legs 78 and 79 respectively face or point outwardly from the spring 77 in opposite directions therefrom so that the extreme free ends 87 and 88 of the spring 77, when in the compressed condition illustrated in FIG. 3, will not bear against the contact member 74 or the heat sensitive member 43 so as to cause canting of the contact member 74 which might cause the contact member 74 to not make contact with the end 30 of the terminal 26.

From the above, it can be seen that the thermally actuatable switch construction 20 of this invention can be assembled in a relatively simple manner.

In particular, when it is desired to assemble a thermally actuatable switch construction 20 of this invention, the cup-shaped housing member 21 is so positioned that the temperature sensitive member 43 can be inserted through the upper open end of the chamber 25 thereof and then press fitted into the position illustrated in FIG. 3. Thereafter, the spring 77 is disposed in the open end of the housing 21 followed by the contact member 74. The compression spring 80 can be either prefastened to the surface 83 of the end plug 24 or the same can be separate therefrom and inserted in through the open end of the housing 21 in a proper position so that subsequently the spring 80 will be received in the recess 84 of the end plug 24 when the end plug 24 is subsequently pushed inwardly in the open end of the housing 21 with the terminals 26 and 27 having their bent ends 30 and 31 respectively disposed around the projection 60 thereof. The end plug 24 is press fitted into the open end of the housing 21 until the tongue 45 of the end plug 24 snaps into the recess 46 in the manner illustrated in FIG. 5 whereby all of the parts have been properly assembled in the chamber 25 of the housing 21.

Thereafter, a suitable epoxy sealing means 47 or other desired material can be disposed on top of the end plug 24 as well as around the terminals 26 and 27 as illustrated to completely and substantially hermitically seal close the open end of the housing 21 as illustrated whereby once the epoxy material 47 hardens, the thermally actuatable switch construction 20 of this invention can be utilized to operate in a manner now to be described.

The terminals 26 and 27 of the thermally actuatable switch construction of 20 can be coupled into a desired electrical circuit to be protected thereby so that the flow of electrical current must pass from terminal 26 through the contact member 74 to the terminal 27 and vice versa. Thus, as long as the temperature being sensed by the thermally actuatable switch construction 20 is below the temperature that will cause the temperature sensitive member 43 to collapse, the contact member 74 remains in contact with the terminals 26 and 27 as illustrated in FIG. 3 and electrical current flows through the switch construction 20.

However, once the temperature being sensed by the temperature sensitive member 43 reaches the predetermined temperature, the material 43 collapses in the manner illustrated in FIG. 4 so that the spring 77 can now expand and thereby loose its compressive force on the contact member 74 so that the compression spring 80, through its compressed condition, can rapidly move the contact member 74 completely away from the ends 30 and 31 of the terminals 27 and 26 to open the electrical circuit therebetween whereby the thus actuated thermally actuated switch construction 20 must be replaced once the same has opened the contact member 74 away from the terminals 26 and 27 in the manner illustrated in FIG. 4.

Thus, it can be seen that the thermally actuatable switch construction 20 of this invention can open an electrical circuit when the construction 20 senses an unsafe temperature.

Therefore, it can be seen that this invention provides an improved thermally actuatable switch construction.

While the form of the invention now preferred has been described and illustrated as required by the Patent Statute, it is to be understood that other forms can be utilized and still come within the scope of the appended claims.

What is claimed is:

1. A thermally actuatable switch comprising a. a housing provided with a relatively thin and wide internal chamber which is closed out at the bottom and open at the top, b. a pair of spaced apart terminals extending into the top of said chamber, c. an end plug snap fitted into said housing to close out the top of said chamber and secure said terminals in place, d. a cylindrical contact having a diameter extending substantially across the entire thickness of said chamber and a length extending substantially the full width of said chamber, e. a coil spring fitted within said end plug between said terminals for urging said contact member downwardly away from said terminals, f. a temperature sensitive member fitted into the lower section of said chamber, which said temperature sensitive member is solid at temperatures below a predetermined design temperature and collapses at temperatures above said design temperature, and g. a reversely looped leaf spring extending across substantially the full thickness and width of said chamber and placed between said temperature sensitive member and said contact member to overcome the action of said coil spring and urge said contact member against said terminals, said leaf spring comprising a C-shaped center section and a pair of reversely bent free ends disposed respectively upwardly and downwardly from said center section, said free ends being medially bent to bear medially against said contact member for causing flush seating thereof against said terminals.

2. A thermally actuatable switch as set forth in claim 1 wherein the side walls of said chamber are tapered for press fitting said temperature sensitive member into place in the bottom of said chamber.

3. A thermally actuatable switch as set forth in claim 1 wherein said terminals each has an end angled in said chamber, said angled ends of said terminals being the parts thereof that are contacted by said contact member.

4. A thermally actuatable switch as set forth in claim 3 wherein said angled ends of said terminals extend substantially from the front of said chamber to the rear thereof.

* * * * *

UNITED STATES PATENT AND TRADEMARK OFFICE

CERTIFICATE OF CORRECTION

PATENT NO. : 3,956,725

DATED : May 11, 1976

INVENTOR(S) : Phillip Edward Merrill and Emil Robert Plasko

It is certified that error appears in the above-identified patent and that said Letters Patent are hereby corrected as shown below:

Column 1, line 47, delete "is".

Column 5, line 33, insert --member-- after "contact".

Signed and Sealed this

Twenty-fourth Day of August 1976

[SEAL]

*Attest:*

RUTH C. MASON
*Attesting Officer*

C. MARSHALL DANN
*Commissioner of Patents and Trademarks*